United States Patent [19]

McClive

[11] Patent Number: 4,930,197

[45] Date of Patent: Jun. 5, 1990

[54] ASSEMBLED CASKET

[76] Inventor: Ralph T. McClive, 88 Knowlton Ave., Kenmore, N.Y. 14217

[21] Appl. No.: 317,657

[22] Filed: Mar. 1, 1989

[51] Int. Cl.[5] ..... A61G 17/00

[52] U.S. Cl. ..... 27/2; 27/5; 27/7; 27/10

[58] Field of Search ..... 27/2–10

[56] References Cited

U.S. PATENT DOCUMENTS

| | | | |
|---|---|---|---|
| 244,317 | 7/1881 | Sander | 27/5 |
| 1,260,927 | 3/1918 | McKinney | 27/7 |
| 1,610,781 | 12/1926 | Hollins | 27/4 |
| 3,531,837 | 10/1970 | Cherry | 27/10 |
| 3,729,786 | 5/1973 | Walding | 27/3 |
| 3,879,818 | 4/1975 | Rowland | 27/7 |
| 4,195,394 | 4/1988 | Semon | 27/10 |
| 4,730,370 | 3/1988 | Elder | 27/4 |

*Primary Examiner*—Richard E. Chilcot, Jr.

[57] ABSTRACT

This invention relates to caskets. It is for caskets that can be fabricated in such a manner that they are adaptable to assembly at point of use. In the manufacture of caskets, the cost of transportation between assembly point and the mortician has continued to grow out of proportion to the cost of the casket. The unassembled or knocked down parts shipped directly to the mortician would reduce freight charges and storage space requirements. By assembly at the point of use it might well lead to lower funeral costs and a wider selection of casket types and styles for the public.

1 Claim, 3 Drawing Sheets

ASSEMBLED CASKET

BACKGROUND OF THE INVENTION

It is the intent of this invention to provide a sturdy, easily joined and presentable product whose components have been prepared at a factory so that the parts can be shipped knocked down for assembly at point of use, by untrained and unskilled labor with minimum tools. In accordance with the present invention there are a bottom, sides and ends sections to be fastened to a sling or strap system and handles inserted into shaped members, that will support the necessary dead weight when carried by pallbrarers.

The present invention provides casket body parts from several available materials whcih can be easily assembled at the point of use to make a casket. A preferred material is hardboard of the type marketed by The Masonite Corportion under the trade name Masonite. Other hardboards ae also available from other sources. This material is sturdy yet can be readily burned when cremation is called for. Using these materials make caskets inexpensive so they can compete with metals and woods but because of the printed finish surface provide these caskets with a most attractive appearance. Plywood backed, particle board backed and paper backed printed surfaces are also usable in this product. Readily available tools such as a screw driver and hammer are all that is required to assemble the casket at the point of use with the components furnished. The interiors and lids of the casket are of a conventional type.

BRIEF DESCRIPTION OF THE DRAWINGS

The invention will be readily understood by reference to the description given herein and the accompanying drawings.

DESCRIPTION OF THE PREFERRED EMBODIMENT

Figure 1:
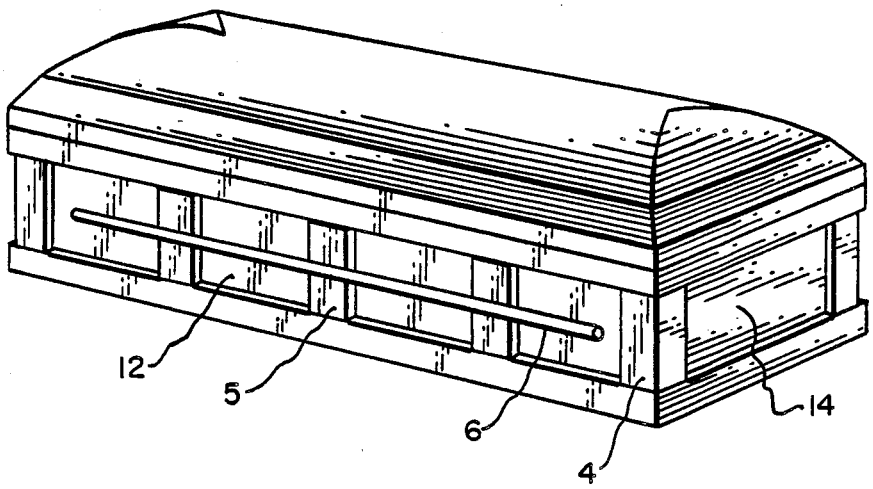
FIG. 1 is a perspective view of a casket, including a lower body section and an upper cover, in closed position.

FIG. 1 shows a perspective view of a casket, including a lower body section and an upper cover in closed position. The box proper has sides 12 and 13 and ends 14 and 15 which can be made of sheet material of plastic, paper, wood, metal, composition board or hard board. External ornamental fixtures made of plastic, wood, metal or paperboard and handles are made part of the assembled unit by drilling corresponding holes in the components and fastening same together by threaded fasteners or rivets.

Figure 2:
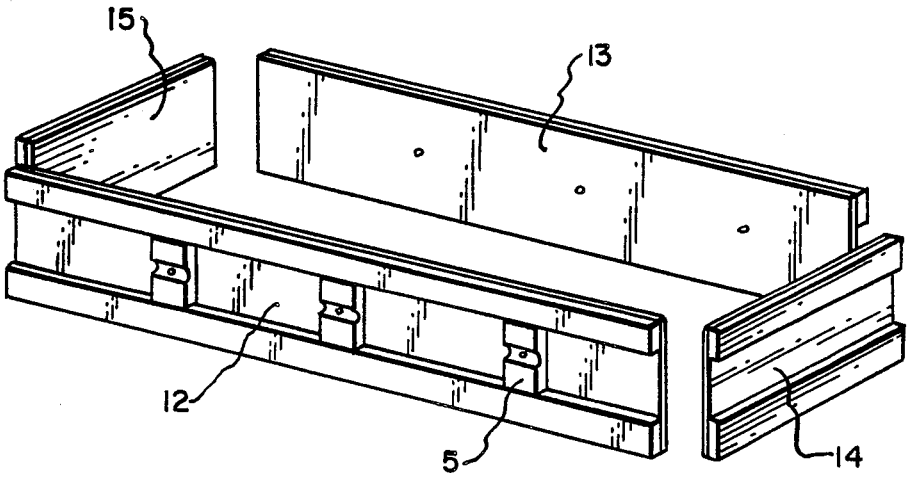
FIG. 2 is a disassembled view in perspective of the side, 12 and 13 and end panels 14 and 15.
Figure 3:
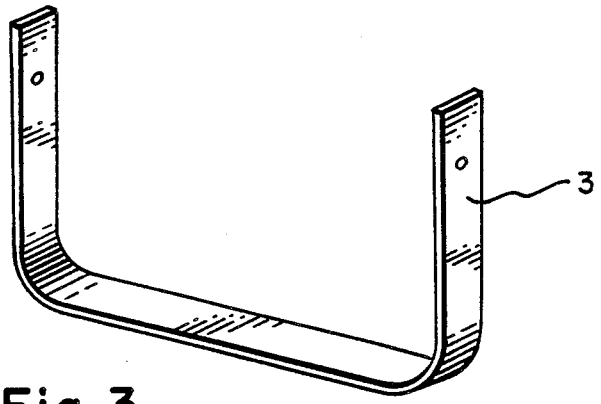
FIG. 3 is a sling or strap support of formed paper board, plywood, plastic or metal.
Figure 4:
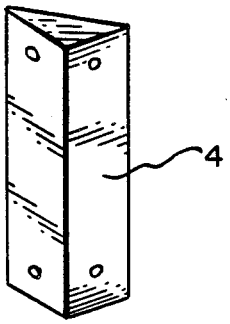
FIG. 4 is one type of a corner piece to hold the sides and end pieces together, made from wood, paperboard, metal or plastic.
Figure 5:
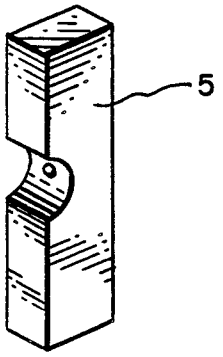
FIG. 5 is a support block preferably wood which has a groove and drilled hole thru which the fastening device passes the handle which rests in the aforementioned groove so the handle, block, side and formed sling or atrap make up the assembly.
Figure 6:
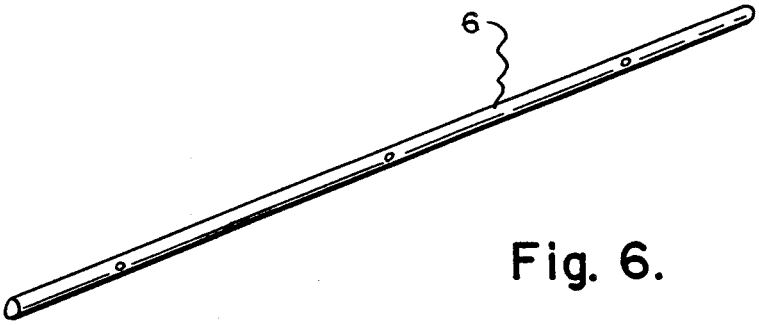
FIG. 6 is handle that extends almost to the end of the casket sides and which has drilled holes for fastening devices to correspond with sides 12 and 13 and slings or straps 3. This can be of wood, metal or plastic.
Figure 8:
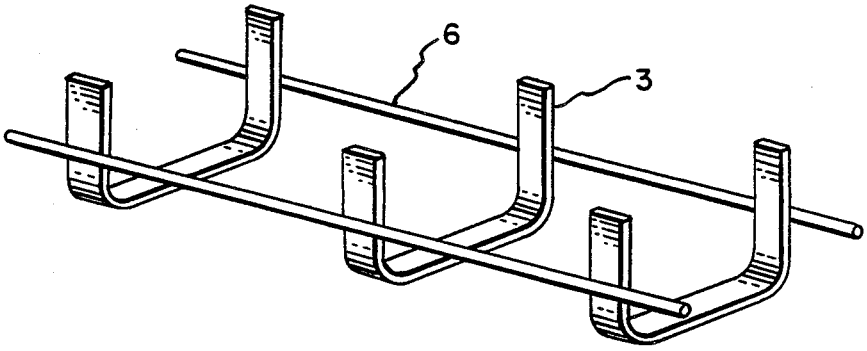
FIG. 8 shows a skeletal view of the slings or straps with handle 6 fastened to the sling or strap 3 without the sides 12 and 13 included in the assembly. Shown for mechanics only.

FIG. 2 shows sides 12 and 13 and ends 14 and 15 as described in FIGS. 1 with blocks 5.

Figure 7:
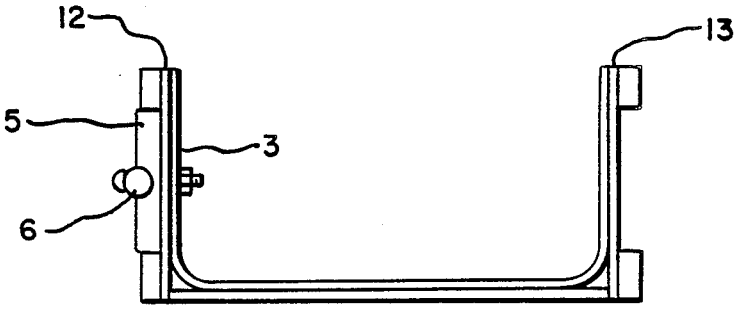
FIG. 7 is an end plain view of a sling or strap section thru which staples, rivets or threaded devices pass to hold the handles, blocks and sides to the formed slings or straps.

FIG. 7 is an end plain view showing sides 12 and 13, sling or strap 3 being the only supporting device for the body of a person, when the rods or handle 6 are inserted in place in blocks 5 as shaped with fastening devices to connect all parts thru pre-drilled holes.

The materials of construction for the manufacture of the present casket body can be synthetic, organic polymeric plastic, metal, wood, hardboard, paperboard, or any synthetic plastic.

It should be understood that various modifications of the described construction may be employed and still be within the invention.

What is claimed is:

1. A ready to assemble casket comprising: a body having a side section, a second side section, a first end section, a second end section, and a bottom; said body further having a plurality of interior reinforcing straps: said casket further comprising a plurality of blocks disposed on the outside of the side sections and opposite the reinforcing straps: each of said blocks having a recess disposed therein for receiving a portion of an elongated handle means, and said casket further comprising fastening means for connecting the portions of the handle means to the blocks and reinforcing straps through the side sections, thereby forming an enclosed casket.

* * * * *